US010071574B2

(12) United States Patent
Kitahara

(10) Patent No.: US 10,071,574 B2
(45) Date of Patent: Sep. 11, 2018

(54) PRINTER

(71) Applicant: TOSHIBA TEC KABUSHIKI KAISHA, Shinagawa-ku, Tokyo (JP)

(72) Inventor: Satoshi Kitahara, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/456,848

(22) Filed: Mar. 13, 2017

(65) Prior Publication Data

US 2018/0009243 A1 Jan. 11, 2018

(30) Foreign Application Priority Data

Jul. 8, 2016 (JP) ..... 2016-135884

(51) Int. Cl.
*B41J 11/70* (2006.01)

(52) U.S. Cl.
CPC ..... *B41J 11/70* (2013.01)

(58) Field of Classification Search
CPC ..... B41J 11/66
See application file for complete search history.

(56) References Cited

U.S. PATENT DOCUMENTS 6,325,558 B1 * 12/2001 Robinson ..... B26F 3/02 225/39
7,510,343 B1 * 3/2009 Arrington ..... B41J 11/70 400/621
2005/0123336 A1 * 6/2005 Oshida ..... B26D 7/22 400/621
2007/0022858 A1 * 2/2007 Shirotori ..... B26D 1/085 83/624
2013/0051892 A1 * 2/2013 Yokoe ..... B41J 11/70 400/621
2013/0164071 A1 * 6/2013 Matsuya ..... B26D 7/22 400/621

FOREIGN PATENT DOCUMENTS

JP 09-216436 8/1997

* cited by examiner

*Primary Examiner* — Shelby Fidler
(74) *Attorney, Agent, or Firm* — Amin, Turocy & Watson LLP

(57) ABSTRACT

A printer comprises a housing which is composed of a box-shaped main body section with an opening on one surface thereof and a cover for opening and closing the opening of the main body section and forming a paper discharge port between the cover and the main body section at the time the cover is located at a position to close the opening; a storage section houses a roll paper; a printing section carries out printing on the paper; a cutter which has a cutting edge used to cut the paper; a support section which supports the cutter in a manner of freely moving between a use position at the time of cutting the paper by the cutting edge and a non-use position close to an edge of the paper discharge port with respect to the use position.

19 Claims, 7 Drawing Sheets

PRINTER

CROSS-REFERENCE TO RELATED APPLICATIONS

This application is based upon and claims the benefit of priority from Japanese Patent Application No. P2016-135884, filed Jul. 8, 2016, the entire contents of which are incorporated herein by reference.

FIELD

Embodiments described herein relate generally to a printer.

BACKGROUND

There is a printer for carrying out printing on a continuous paper which is provided with a cutter for cutting a paper in a conventional manner. The cutter is arranged at a paper discharge port for discharging the paper to the outside from a housing of the printer.

The printer using the continuous paper houses a wound part (roll part) of the paper in the housing and draws out a front end of the paper from the paper discharge port to use the paper. Thus, the paper discharge port is arranged between an opening of the housing and a cover for opening and closing the opening. In this case, in a state of opening the cover, a part constituting the paper discharge port is divided into two portions.

The cutter is arranged at either one of the two divided portions. As a result, the cutter is exposed in the open state of the cover of the housing such that the cutter can be touched by a user or another. Thus, conventionally, the cutter is formed by a molding material with primary priority given to safety; however, satisfactory sharpness cannot be obtained according to the primary concern over safety rather than cutting quality.

DETAILED DESCRIPTION

In accordance with an embodiment, a printer comprises a housing, a storage section, a printing section, a cutter and a support section. The housing is composed of a box-shaped main body section with an opening on one surface thereof and a cover which is cover for opening and closing the opening of the main body section and forms a paper discharge port between the cover and the main body section at the time the cover is located at a position to close the opening. The storage section is arranged in the housing to house a roll paper obtained by winding a belt-like paper. The printing section is arranged in the housing to carry out printing on the paper. The cutter has a cutting edge used to cut the paper. The support section supports the cutter in a manner of freely moving between a use position at the time of cutting the paper by the cutting edge and a non-use position close to an edge of the paper discharge port with respect to the use position.

First Embodiment

Figure 1:
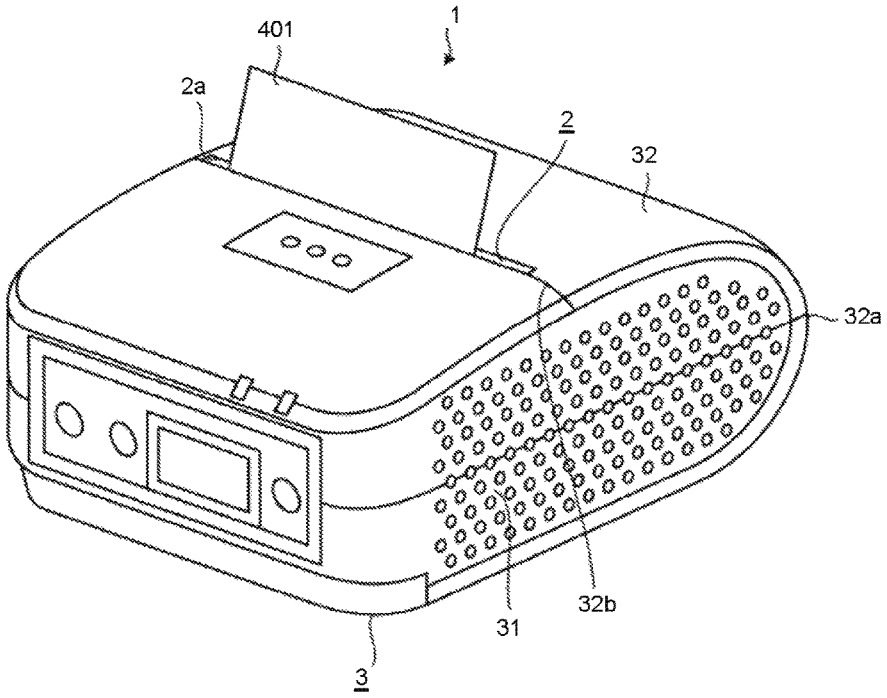
FIG. 1 is a perspective view illustrating the appearance of a printer according to an embodiment.

An embodiment is described with reference to the accompanying drawings. FIG. 1 is a perspective view illustrating the appearance of a printer 1 according to the present embodiment. The printer 1 includes a housing 3 having a paper discharge port 2. The housing 3 is divided into a main body section 31 and a cover 32.

Figure 2:
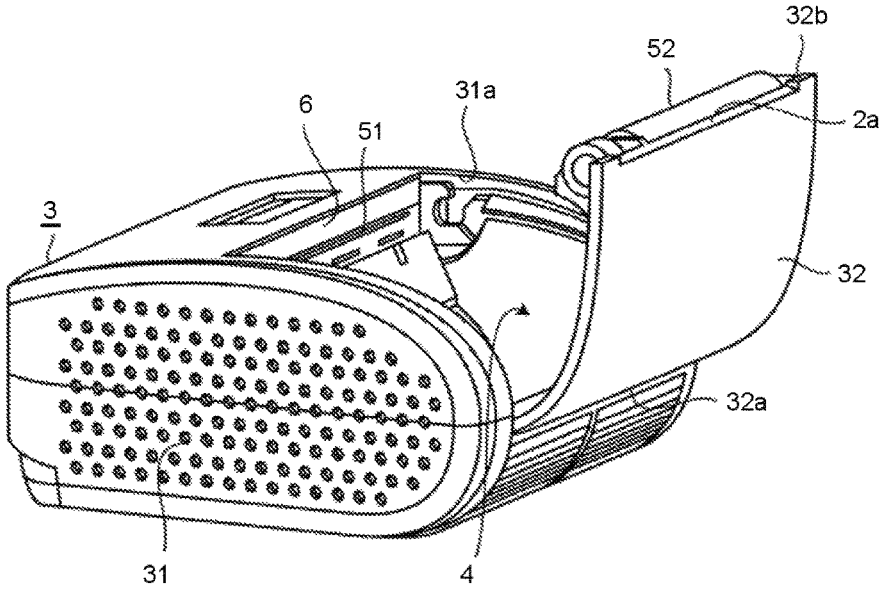
FIG. 2 is a perspective view illustrating the appearance of the printer in a state in which a cover is opened.

FIG. 2 is a perspective view illustrating the appearance of the printer 1 in a state in which the cover 32 is opened. The main body section 31 is a box-shaped container with an opening 31*a* on one surface thereof. The cover 32 opens and closes the opening 31*a*.

The cover 32 is mounted in the main body section 31 with one end 32*a* thereof rotatable. The cover 32 moves between a position where the opening 31*a* is closed and a position where the opening 31*a* is opened by rotating around the one end 32*a*.

Return to FIG. 1, the paper discharge port 2 is a slit-shaped hole formed in the housing 3. The paper discharge port 2 is formed between the opening 31*a* and a front end 32*b* of the cover 32 in a state in which the cover 32 is located at a position to close the opening 31*a*. Herein, the front end 32*b* contains an opposite side of the one end 32*a* described above.

The dimension of the paper discharge port 2 along a width direction of a paper 401 (described later) is a value obtained by adding 2-3 mm to the maximum value of the width of the paper 401. Further, the dimension of the paper discharge port 2 along a thickness direction of the paper 401 is about 2-3 mm.

Figure 3:
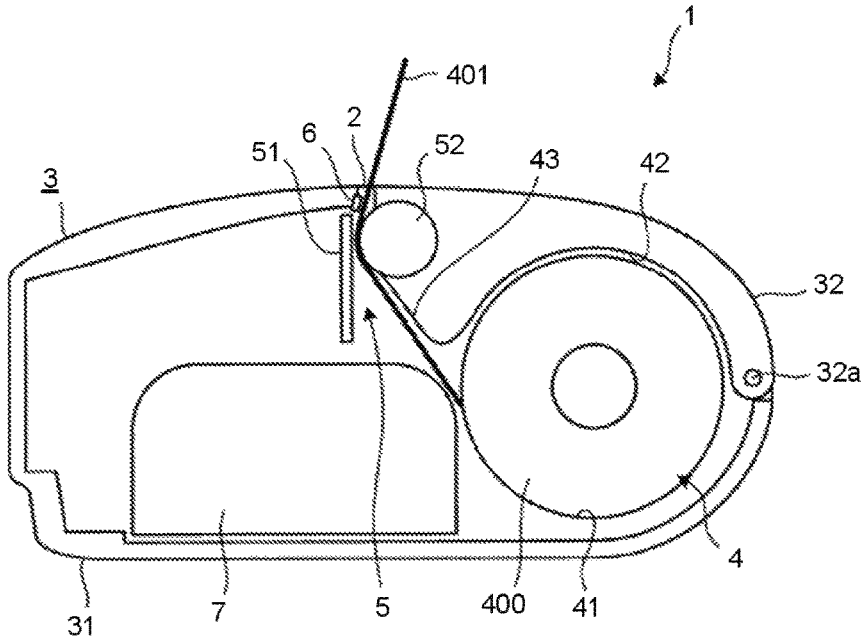
FIG. 3 is a longitudinal side view schematically illustrating the internal structure of the printer.
Figure 4:
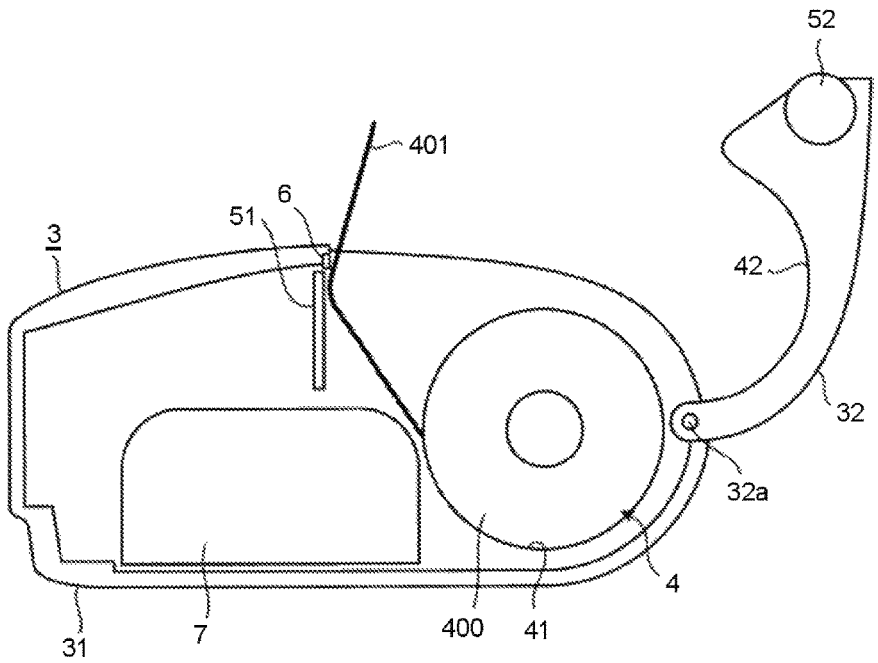
FIG. 4 is a longitudinal side view of the printer in a state in which the cover is opened.

FIG. 3 is a longitudinal side view schematically illustrating the internal structure of the printer 1. FIG. 4 is a longitudinal side view of the printer 1 in a state in which the cover 32 is opened. The printer 1 includes a paper storage section 4, a printing section 5, a cutting section 6 and a battery 7 in the housing 3.

The battery 7 is a power supply section that supplies electric power consumed by the printing section 5, a control board (not shown), a sensor and an LED (Light Emitting Diode) and the like.

The paper storage section 4 includes a semicylindrical bottom surface 41 and a portion surrounded by the bottom surface 41 and a semicylindrical top surface 42 at the inner side of the cover 32. The paper storage section 4 houses a roll paper 400 obtained by winding a belt-like paper 401 (continuous paper). The roll paper 400 is placed on the bottom surface 41. The paper 401 pulled out from the roll paper 400 stored in the paper storage section 4 is discharged from paper discharge port 2 to the outside of the housing 3.

In a state in which the cover 32 is located at a position to close the opening 31*a*, a conveyance path 43 through which the paper 401 passes is formed in a section from the paper storage section 4 to the paper discharge port 2.

The printing section 5 has a head 51 and a platen roller 52 to execute printing while conveying the paper 401. The head 51 and the platen roller 52 face each other across the conveyance path 43. The head 51 is, for example, a line thermal head having a plurality of heat generating elements arranged in a row. The platen roller 52 rotates by receiving a driving force of a motor (not shown). The platen roller 52 presses the paper 401 against the head 51 and rotates to convey the paper 401. The head 51 heats a predetermined portion of the conveyed paper 401 by energizing predetermined heat generating elements at a predetermined timing.

Furthermore, the printer 1 includes a controller and an opening and closing sensor that are not shown. The opening and closing sensor detects an opened and closed state of the cover 32. The controller does not enable the printing section 5 to carry out printing at the time the opening of the cover 32 is detected by the opening and closing sensor. The controller executes the printing on condition that the cover 32 is closed.

The cutting section 6 of the present embodiment is mounted in the main body section 31. As shown in FIG. 2, the cutting section 6 is provided in such a manner that a longitudinal direction thereof is arranged along the opening 31*a*. In other words, the cutting section 6 is provided along the width direction of the paper 401.

The cutting section 6 is used to manually cut the paper 401. In other words, the user of the printer 1 pinches a discharged part of the paper 401 and presses the paper 401 against the cutting section 6 while pulling the paper 401 towards an oblique direction, and in this way, the paper 401 is cut from the part pressed against the cutting section 6.

Similar to the cutting section 6, a cutter which presses the paper 401 by sharply bending the paper 401 to cut the paper 401 is provided at the paper discharge port 2. Therefore, as in the present embodiment, in the printer 1 with a structure in which the paper discharge port 2 is divided at the time the cover 32 is opened, if the conventional cutter is adopted, there is a risk of damaging a finger of the user at the time of replenishing the roll paper 400. On the other hand, the cutting section 6 of the present embodiment has a structure that is hard to touch by the user even if the cover 32 is opened.

Figure 5:
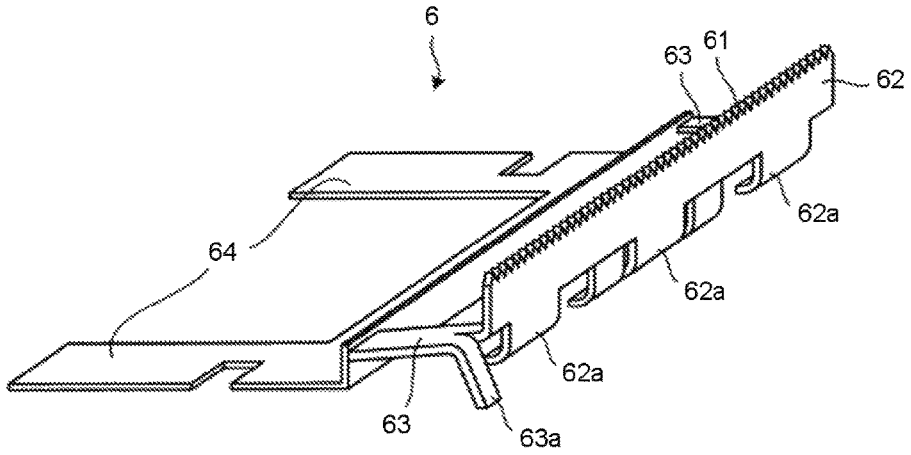
FIG. 5 is a perspective view illustrating the appearance of a cutting section.

FIG. 5 is a perspective view illustrating the appearance of the cutting section 6. The cutting section 6 includes a flat plate section (cutter) 62 having the cutting edge 61, a pair of support sections 63 and a mounting section 64. The cutting section 6 in the present embodiment is made of metal.

The mounting section 64 is used to mount the cutting section 6 in the main body section 31.

The flat plate section 62 has a substantially rectangular flat plate shape, and the cutting edge 61 is formed at one of long sides (upper side in a state in which the cutting section 6 is mounted) of the flat plate section 62.

The length of the cutting edge 61 is a value obtained by adding 2-3 mm to the maximum value of the width of the paper 401 similarly to the dimension of the paper discharge port 2 along the width direction of the paper 401. The blade 61 in the present embodiment is formed into a saw shape (jagged).

The flat plate section 62 has a plurality of paper guide sections 62*a* at the lower side thereof. The "lower side" is the long side (lower side in a state in which the cutting section 6 is mounted) opposite to the cutting edge 61. The paper guide section 62*a* is formed by curving a part projecting over the lower side of the flat plate section 62 from a front surface (a surface contacting the paper 401) side of the flat plate section 62 to a back surface side thereof. The paper guide section 62*a* guides the paper 401 to the paper discharge port 2 to prevent the paper 401 from accidentally entering the back surface side of the flat plate section 62.

The support section 63 supports the flat plate section 62 in a manner of freely moving between a non-use position where the cutting edge 61 contacts the edge of the paper discharge port 2 and a use position where the cutting edge 61 separates from the edge of the paper discharge port 2.

The support sections 63 are located between the both ends of the flat plate section 62 and the mounting section 64 to connect the flat plate section 62 with the mounting section 64. The support section 63 has an elastic force to function as a leaf spring.

Further, the support section 63 has a lever 63*a* which projects obliquely downward from the front surface side of the flat plate section 62. The lever 63*a* is included in each support section 63 and is arranged at both lateral parts of the cutting section 6.

The lever 63*a* is pressed downwards by the front end 32*b* of the cover 32 at the time the cover 32 is located at a position to close the opening 31*a*. In response to a pressing down force, the supporting section 63 is curved downward. In this way, the flat plate section 62 becomes a state (use state) of adopting a gesture in which the surface thereof faces obliquely downward (refer to FIG. 6). The state shown in FIG. 5 is a state (non-use state) in which the lever 63*a* is not pressed down (refer to FIG. 7). In the main body section 31, a part which is the edge of the opening 31*a* is provided with a recess 31*b* into which the flat plate section 62 in the non-use state enters.

Figure 6:
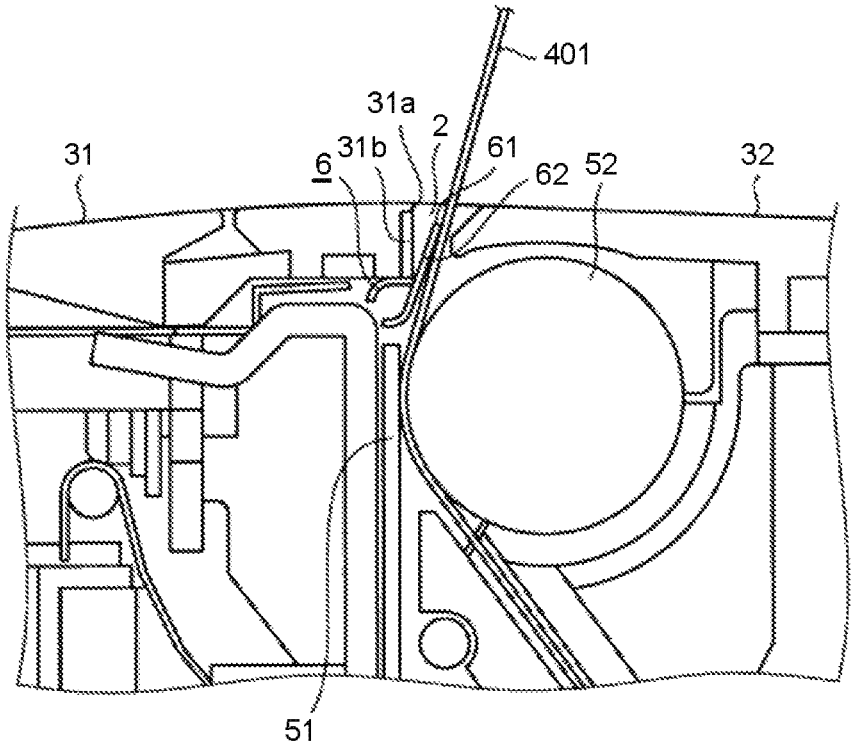
FIG. 6 is a longitudinal side view illustrating a position of a flat plate section in a state in which the cover is closed.
Figure 7:
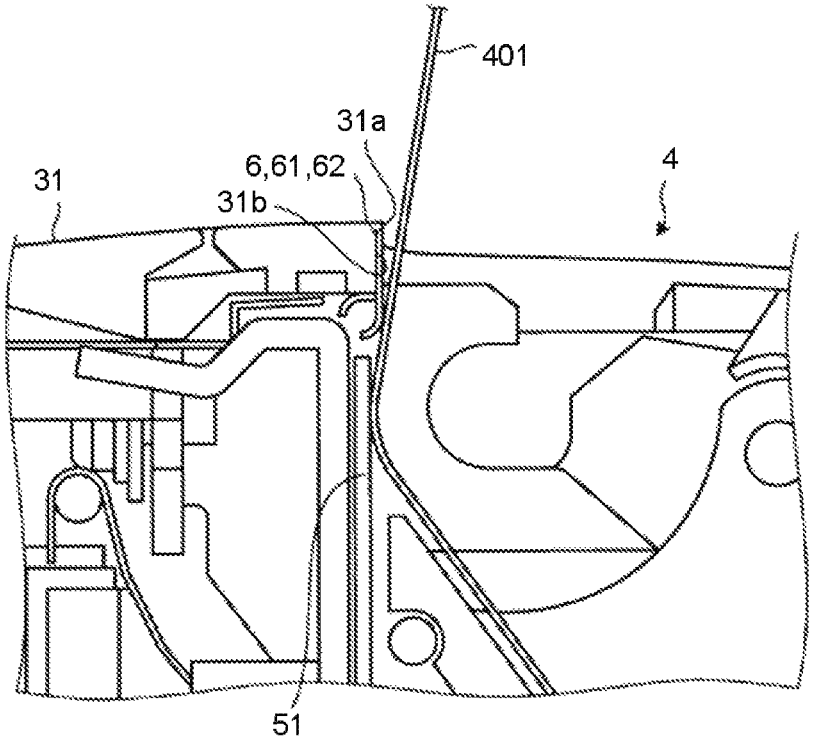
FIG. 7 is a longitudinal side view illustrating a position of the flat plate section in a state in which the cover is opened.

The operation in such a constitution is described below with reference to FIG. 6 and FIG. 7. FIG. 6 is a longitudinal side view illustrating the position of the flat plate section 62 in a state of the cover 32 is closed. FIG. 7 is a longitudinal side view illustrating the position of the flat plate section 62 in a state of the cover 32 is opened. As FIG. 6 and FIG. 7 show a cutting surface at the center in the width direction of the paper 401 of the printer 1, the lever 63*a* is not shown in those drawings.

First, as shown in FIG. 7, at the time the opening 31*a* is opened, the flat plate section 62 takes a gesture in which the flat surface thereof is schematically along the vertical direction and enters the recess 31*b* to be stored.

On the other hand, as shown in FIG. 6, if the cover 32 closes the opening 31*a*, the front end 32*b* of the cover 32 presses the lever 63*a* downwards. In this way, the support section 63 is curved downward; the flat plate section 62 leaves the recess 31*b*; and the front surface of the flat plate section 62 faces obliquely downwards. By this operation, the cutting edge 61 is moved to a position (use position) 1-2 mm away from the edge of the opening 31*a* from the inside (non-use position) of the recess 31*b*. The use position of the cutting edge 61 is in the vicinity of the center of the paper discharge port 2 in the thickness direction of the paper 401.

In a state in which the cover 32 is closed, the cutting edge 61 can be seen from the paper discharge port 2; however, since the paper discharge port 2 is sufficiently narrow as described above (the size thereof in the thickness direction of the paper 401 is 2-3 mm), there is no worry that the user of the printer 1 is injured by touching the cutting edge 61.

In this way, the cutting edge 61 is moved in the direction of entering and leaving the edge of the opening 31*a* along with the movement of the cover 32.

At the time the opening 31*a* is opened, the cutting edge 61 is housed in the recess 31*b*, and in this way, inconvenience such as injury of the user caused by accidentally touching the cutting edge 61 at the time of replenishing the roll paper 400 is difficult to occur. Therefore, according to the present embodiment, it is possible to provide the printer with high safety. Due to adoption of such a structure, it is possible to form the cutting edge 61 by a material and a shape with good sharpness.

At the time the cover 32 closes the opening 31*a*, the cutting edge 61 leaves the edge of the opening 31*a* and reaches the middle of the paper discharging port 2, and in this way, the paper 401 can be bent at a sufficient angle at the time of pressing the paper 401 against the cutting edge 61 when the paper 401 is cut. Thus, the paper 401 can be easily cut and a beautiful cut end can be easily obtained.

As described above, in the present embodiment, since the flat plate section 62 is freely movable between the non-use position and the use position, the flat plate section 62 is placed at the non-use position and is difficult to touch at the time of replenishing the roll paper 400. Therefore, according to the present embodiment, it is possible to provide the printer with high safety, which easily cuts the paper 401.

As in the present embodiment, if the printer 1 has a constitution in which the flat plate section 62 moves in conjunction with the opening and closing of the cover 32, since there is no need for the user to consciously move the flat plate section 62, convenience is high and the safety is also high.

Further, as in the present embodiment, if the movement of the flat plate section 62 is rotation, the angle of the flat plate section 62 at the use position can be an angle at which the paper 401 is easily cut as compared with a case of parallel movement from the non-use position.

In the present embodiment, an application to the printer 1 which is small and usable by being carried is described an example; however, it may be applied to a printer of a size that cannot be carried in practice.

In the present embodiment, the cutting edge 61 enters and leaves the edge of the opening 31*a*; however, the recess 31*b* may be not provided in practice. In other words, the cutting edge 61 may contact the edge of the opening 31*a* or may be sufficiently close to the edge of the opening 31*a* (Here, sufficiently close means a state in which there is a predetermined gap between the cutting edge 61 and the edge of the opening 31*a*. The gap is too small to catch the skin of the finger in, and is, for example, 1 mm or less) even if the cutting edge 61 does not enter deeply with respect to the edge of the opening 31*a* in the state in which the cover 32 is not opened. With such a structure, even if the finger touches the flat plate section 62, since it is difficult for the finger to be damaged by the cutting edge 61, sufficient safety can be obtained as in the present embodiment.

Further, in the present embodiment, the cutting section 6 is mounted in the main body section 31; however, the cutting section 6 may be mounted in either the main body section 31 or the cover 32 as long as the cutting edge 61 can move between a position close to the edge of the opening and a position separated from the edge of the opening.

In the present embodiment, the elasticity for moving the cutting section 6 is realized by the support section 63 in the form of a leaf spring. However, in practice, the elasticity may be realized by other kinds of spring such as a torsion spring.

Furthermore, in the present embodiment, by providing the support section 63 of the cutting section 6 with elasticity, the movement of the cutting edge 61 along with the opening and closing of the cover 32 is realized; however, in practice, the movement of the cutting edge 61 may be realized with other methods. Examples of the method (Examples 1 to 3) are shown below.

Example 1

A gear for transmitting the rotation of the cover 32 to the cutting section 6 is provided in the printer 1 to rotate the flat plate section 62 by a predetermined angle along with the opening and closing operation of the cover 32. Thereby, the flat plate section 62 is housed in (or is close to) the edge of the opening 31*a* if the cover 32 is opened, and the flat plate section 62 is separated from the edge of the opening 31*a* if the cover 32 is closed.

Example 2

A moving mechanism for moving the flat plate section 62 from the non-use position (position shown in FIG. 7) to the use position (position shown in FIG. 6) by the electric force of a motor is provided in the cutting section 6. The timing at which the moving mechanism moves the flat plate section 62 to the use position may be a timing at which the cover 32 is closed or at which the paper 401 is discharged from the paper discharge port 2.

Since the printer 1 is provided with the opening and closing sensor for detecting the opened and closed state of the cover 32 conventionally, it is possible to control the moving mechanism to operate on condition that the opening and closing sensor detects that the cover 32 is closed.

Example 3

A mechanism for slidably moving the flat plate section 62 along a rail between the non-use position and the use position and locking the flat plate section 62 in a non-movable manner at each position is provided in the cutting section 6. The slide movement and locking and unlocking at each position are executed manually by the user.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a housing comprising a main body section with an opening on one surface thereof;

a cover for opening and closing the opening of the main body section;

a paper discharge port between the cover and the main body section at the time the cover is in a closed position with respect to the opening;

a storage section configured to house a roll paper; and a printing section configured to carry out printing on the roll paper;

a flat plate section comprising:

a mounting section that attaches the flat plate section to the main body section;

a cutting edge for cutting the roll paper; and a pair of support sections attached to the mounting section at opposite ends of the flat plate section and comprising respective levers that project downward from a front surface side of the flat plate section, the pair of support sections are configured to support the flat plate section in a manner of freely moving between a use position at the time of cutting the roll paper by the cutting edge and a non-use position close to an edge of the paper discharge port with respect to the use position, and wherein a downward pressure on the respective levers at a front end of the cover curves the cutting edge downward and causes the support section to create an elastic force that operates as a spring and moves the flat plate section to the use position.

2. The printer according to claim 1, wherein
the support section positions the flat plate section at the non-use position at the time the cover is in an open position with respect to the opening.

3. The printer according to claim 2, wherein
the pair of support sections position the flat plate section at the use position at the time the cover is in the closed position with respect to the opening.

4. The printer according to claim 2, wherein
the support section positions the flat plate section at the non-use position at the time the cover is in the open position with respect to the opening.

5. The printer according to claim 1, wherein
the housing has a recess in which the flat plate section enters at the edge of the paper discharge port as the non-use position.

6. The printer according to claim 5, wherein
the cutting edge of the flat plate section is configured to enter the recess in the non-use position.

7. The printer according to claim 1, wherein
the housing comprises a box-shaped main body section.

8. The printer according to claim 1, wherein
the paper discharge port comprises a slit-shaped hole in the housing.

9. The printer according to claim 1, wherein
the cover rotates about an end to switch between the opened and closed positions.

10. The printer according to claim 1, wherein
the flat plate section comprises metal on the cutting edge.

11. A portable printer, comprising:
a housing comprising
a main body section with an opening on one surface thereof;
a cover for opening and closing the opening of the main body section;
a recess;
a paper discharge port between the cover and the main body section at the time the cover is in a closed position with respect to the opening;
a storage section configured to house a roll paper; and
a printing section configured to carry out printing on the roll paper;
a cutter attached to the main body section at a mounting section, the cutter comprising:
a cutting edge for cutting the roll paper, the cutter configured to enter the recess as a non-use position; and
a support section attached to the mounting section and comprising a spring and a lever that projects downward from a front surface side of the cutter, the support section is configured to support the cutter in a manner of freely moving between a use position at the time of cutting the roll paper by the cutting edge and the non-use position close to an edge of the paper discharge port with respect to the use position, and wherein a downward pressure on the lever at a front end of the cover curves the cutting edge downward and causes the spring to provide an elastic force and moves the cutter toward the use position.

12. The portable printer according to claim 11, wherein
the paper discharge port comprises a slit-shaped hole in the housing.

13. The portable printer according to claim 11, wherein
the cover rotates about an end to switch between the opened and closed positions.

14. The portable printer according to claim 11, wherein
the support section positions the cutter at the non-use position at the time the cover is in an open position with respect to the opening.

15. The portable printer according to claim 11, wherein
the support section positions the cutter at the use position at the time the cover is in the closed position with respect to the opening.

16. The portable printer according to claim 11, wherein
the support section positions the cutter at the non-use position at the time the cover is in the open position with respect to the opening.

17. The portable printer according to claim 11, wherein
the cutter comprises a flat plate section comprising metal on the cutting edge.

18. The portable printer according to claim 11, wherein
the cutting edge has a saw-shape.

19. A method of preventing injury to a user of a portable printer, comprising:
providing a housing comprising a main body section, a cover that opens and closes the main body section, a recess, a paper discharge port between the cover and the main body section when the cover is in a closed position, a storage section that houses paper, and a printing section that facilitates printing on the paper;
providing a cutter attached to the main body section at a mounting section, the cutter comprising a cutting edge, a support section attached to the mounting section and comprising a lever;
configuring the cutter to enter the recess when in a non-use position;
configuring the support section to support the cutter in a manner that freely moves between a use position and the non-use position, wherein in the use position the cutting edge cuts the paper; and
configuring the lever such that a downward pressure on the lever at a front end of the cover curves the cutting edge downward and moves the cutter toward the use position by an elastic force of the support section that operates as a spring on the cutter.

* * * * *